US008612237B2

(12) United States Patent
Baumgarte

(10) Patent No.: US 8,612,237 B2
(45) Date of Patent: Dec. 17, 2013

(54) METHOD AND APPARATUS FOR DETERMINING AUDIO SPATIAL QUALITY

(75) Inventor: Frank M. Baumgarte, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 1380 days.

(21) Appl. No.: 11/696,641

(22) Filed: Apr. 4, 2007

(65) Prior Publication Data

US 2008/0249769 A1 Oct. 9, 2008

(51) Int. Cl.
*G10L 19/00* (2013.01)
*G10L 21/00* (2013.01)

(52) U.S. Cl.
USPC ..... 704/500; 381/58

(58) Field of Classification Search
USPC ..... 704/220, 231, 236, 270, E19.002; 381/1, 58, 307
See application file for complete search history.

(56) References Cited

U.S. PATENT DOCUMENTS

| | | | | |
|---|---|---|---|---|
| 5,886,988 | A * | 3/1999 | Yun et al. | 370/329 |
| 6,798,889 | B1 * | 9/2004 | Dicker et al. | 381/303 |
| 7,024,259 | B1 * | 4/2006 | Sporer et al. | 700/94 |
| 7,027,982 | B2 * | 4/2006 | Chen et al. | 704/230 |
| 7,120,256 | B2 * | 10/2006 | Grancea et al. | 381/55 |
| 7,146,313 | B2 * | 12/2006 | Chen et al. | 704/230 |
| 7,502,743 | B2 * | 3/2009 | Thumpudi et al. | 704/500 |
| 7,555,131 | B2 * | 6/2009 | Hollowbush et al. | 381/58 |
| 7,660,424 | B2 * | 2/2010 | Davis | 381/20 |
| 7,715,575 | B1 * | 5/2010 | Sakurai et al. | 381/309 |
| 7,983,922 | B2 * | 7/2011 | Neusinger et al. | 704/500 |
| 8,069,050 | B2 * | 11/2011 | Thumpudi et al. | 704/500 |
| 8,069,052 | B2 * | 11/2011 | Thumpudi et al. | 704/503 |
| 8,099,292 | B2 * | 1/2012 | Thumpudi et al. | 704/500 |
| 8,145,498 | B2 * | 3/2012 | Herre et al. | 704/500 |
| 2004/0062401 | A1 * | 4/2004 | Davis | 381/1 |
| 2007/0002971 | A1 * | 1/2007 | Purnhagen et al. | 375/316 |
| 2007/0127733 | A1 * | 6/2007 | Henn et al. | 381/80 |
| 2007/0258607 | A1 * | 11/2007 | Purnhagen et al. | 381/307 |
| 2007/0269063 | A1 * | 11/2007 | Goodwin et al. | 381/310 |
| 2007/0291951 | A1 * | 12/2007 | Faller | 381/22 |
| 2008/0002842 | A1 * | 1/2008 | Neusinger et al. | 381/119 |
| 2008/0013614 | A1 * | 1/2008 | Fiesel et al. | 375/224 |
| 2008/0249769 | A1 * | 10/2008 | Baumgarte | 704/227 |
| 2009/0171671 | A1 * | 7/2009 | Seo et al. | 704/500 |
| 2011/0235810 | A1 * | 9/2011 | Neusinger et al. | 381/23 |

OTHER PUBLICATIONS

George et al, "Initial Developments of an Objective Method for the Prediction of Basic Audio Quality for Surround Audio Recordings," Audio Eng. Soc. 120th Convention, Paris, France, May 2006, pp. 1-17.*

(Continued)

*Primary Examiner* — Michael N Opsasnick
*Assistant Examiner* — Matthew Baker
(74) *Attorney, Agent, or Firm* — Blakely, Sokoloff, Taylor & Zafman LLP

(57) ABSTRACT

Techniques for evaluating the audio quality of an audio test signal are disclosed. These techniques provide a quality analysis that takes into account spatial audio distortions between the audio test signal and a reference audio signal. These techniques involve, for example, determining a plurality of audio spatial cues for an audio test signal, determining a corresponding plurality of audio spatial cues for an audio reference signal, comparing the determined audio spatial cues of the audio test signal to the audio spatial cues of the audio reference signal, and determining the audio quality of the audio test signal.

19 Claims, 14 Drawing Sheets

(56) References Cited

OTHER PUBLICATIONS

Zielinski et al, "Development and initial validation of a multichannel audio quality expert system," J. Audio Eng. Soc., vol. 53, No. 1/2, Jan. 2005, pp. 4-21.*
Torres-Guijarro et al, "Inter-channel De-correlation for Perceptual Audio Coding," Applied Acoustics, vol. 66, Issue 8, Aug. 2005, pp. 889-901.*
Torres-Guijarro et al, "Coding Strategies and Quality Measure for Multichannel Audio" AES 116th Convention, Berlin, May 2004, pp. 1-6.*
Choi et al, "Prediction of Perceived Quality in Multi-Channel Audio Compression Coding Systems," AES 30th International Conference, Finland, Mar. 2007, pp. 1-9.*
Breebaart, J., Herre, J., Faller, C., Röden, J., Myburg, F., Disch, S., Purnhagen, H., Hortho, G., Neusinger, M., Kjörling, K., Oomen, W. MPEG spatial audio coding / MPEG surround: Overview and current status (2005) . Audio Engineering Society—AES-: 119th convention of the Audio Engineering Society. Fall papers: Held Oct. 7-10, 2005, New York.*
Herre, J, Purnhagen, H, Breebaart, J, Faller, Christof, Disch, S, Kjörling, K, Schuijers, E, Hilpert, J, Myburg, F. The Reference Model Architecture for MPEG Spatial Audio Coding (2005).*
Goodwin, Michael M.; Jot, Jean-Marc. A Frequency-domain Framework for Spatial Audio Coding Based on Universal Spatial Cues. Affiliation: Creative ATC. AES Convention:120 (May 2006) Paper No. 6751.*
Thiede, Thilo; Treurniet, William C.; Bitto, Roland; Schmidmer, Christian; Sporer, Thomas; Beerends, John G.; Colomes, Catherine. PEAQ—The ITU Standard for Objective Measurement of Perceived Audio Quality. JAES vol. 48 Issue 1/2 pp. 3-29; Feb. 2000.*
Han-gil Moon; Jeong-il Seo; Seungkwon Baek; Koeng-Mo Sung; , "A multi-channel audio compression method with virtual source location information for MPEG-4 SAC," Consumer Electronics, IEEE Transactions on , vol. 51, No. 4, pp. 1253-1259, Nov. 2005.*
Disch, Sascha; Ertel, Christian; Faller, Christof; Herre, Juergen; Hilpert, Johannes; Hoelzer, Andreas; Kroon, Peter; Linzmeier, Karsten; Spenger, Claus. Spatial Audio Coding: Next-Generation Efficient and Compatible Coding of Multi-Channel Audio. AES Convention:117 (Oct. 2004) Paper No. 6186.*
Rix, A.W.; Beerends, J.G.; Doh-Suk Kim; Kroon, P.; Ghitza, O., "Objective Assessment of Speech and Audio Quality—Technology and Applications," Audio, Speech, and Language Processing, IEEE Transactions on , vol. 14, No. 6, pp. 1890,1901, Nov. 2006.*
Huber, R. Kollmeier, B. , "PEMO-Q—A New Method for Objective Audio Quality Assessment Using a Model of Auditory Perception" Audio, Speech, and Language Processing, IEEE Transactions on , vol. 14, No. 6, pp. 1902,1911, Nov. 2006.*
Soledad Torres-Guijarro, Jon A. Beracoechea-Álava, Luis I. Ortiz-Berenguer, F. Javier Casajús-Quirós, Inter-channel de-correlation for perceptual audio coding, Applied Acoustics, vol. 66, Issue 8, Aug. 2005, pp. 889-901.*
Faller, Christof; Baumgarte, Frank. Binaural Cue Coding Applied to Audio Compression with Flexible Rendering. AES Convention:113 (Oct. 2002) Paper No. 5686.*
Baumgarte et al., "Binaural Cue Codling—Part I: Psychoacoustic Fundamentals and Design Principles", IEEE Transactions on Speech and Audio Processing, vol. II, No. 6, Nov. 2003, pp. 509-519.
Faller et al., "Binaural Cue Coding—Part II: Schemes and Applications", IEEE Transactions on Speech and Audio Processing, vol. II, No. 6, Nov. 2003, pp. 520-531.
Karjalainen, "A Binaural Auditory Model for Sound Quality Measurements and Spatial Hearing Studies", Proc. IEEE ICASSP, 1996, pp. 985-988.
"Method for Objective Measurements of Perceived Audio Quality", Rec. ITU-R BS.1387, 1998, 89 pgs.

* cited by examiner

METHOD AND APPARATUS FOR DETERMINING AUDIO SPATIAL QUALITY

BACKGROUND OF THE INVENTION

1. Field of the Invention

In general, the invention relates to sound quality assessment of processed audio files, and, more particularly, to evaluation of the sound quality of multi-channel audio files.

2. Description of the Related Art

In recent years, there has been a proliferation of digital media players (e.g., media players capable of playing digital audio files). Typically, these digital media players play digitally encoded audio or video files that have been "compressed" using any number of digital compression methods. Digital audio compression can be classified as 'lossless' or 'lossy'. Lossless data compression allows the recovery of the exact original data that was compressed, while data compressed with lossy data compression yields data files that are different from the source files, but are close enough to be useful in some way. Typically, lossless compression is used to compress data files, such as computer programs, text files, and other files that must remain unaltered in order to be useful at a later time. Conversely, lossy data compression is commonly used to compress multimedia data, including audio, video, and picture files. Lossy compression is useful in multimedia applications such as streaming audio and/or video, music storage, and internet telephony.

The advantage of lossy compression over lossless compression is that a lossy method typically produces a much smaller file than a lossless compression would for the same file. This is advantageous in that storing or streaming digital media is most efficient with smaller file sizes and/or lower bit rates. However, files that have been compressed using lossy methods suffer from a variety of distortions, which may or may not be perceivable to the human ear or eye. Lossy methods often compress by focusing on the limitations of human perception, removing data that cannot be perceived by the average person.

In the case of audio compression, lossy methods can ignore or downplay sound frequencies that are known to be inaudible to the typical human ear. In order to model the human ear, for example, a psychoacoustic model can be used to determine how to compress audio without degrading the perceived quality of sound.

Audio files can typically be compressed at ratios of about 10:1 without perceptible loss of quality. Examples of lossy compression schemes used to encode digital audio files include MPEG-1 layer 2, MPEG-1 Layer 3 (MP3), MPEG-AAC, WMA, Dolby AC-3, Ogg Vorbis, and others.

Objective audio quality assessment aims at replacing expensive subjective listening tests (e.g., panels of human listeners) for audio quality evaluation. Objective assessment methods are generally fully automated, i.e. implemented on a computer with software. The interest in objective measures is driven by the demand for accurate audio quality evaluations, for instance to compare different audio coders or other audio processing devices. Commonly, in a testing scenario, the audio coder or other processing device is called a "device under test" (DUT). FIG. 1 is a block diagram of an audio quality testing setup 100. Reference audio signal 101 is input into the DUT 103. The DUT 103 outputs a processed audio signal 105 (e.g., a digitally compressed audio file or stream that has been restored so that it can be heard). The processed audio signal 105 is then fed into the audio quality tester 107, along with the original reference audio signal 101. In the audio quality tester 107, the processed audio signal 105 is compared to the reference audio signal 101 in order to determine the quality of the processed audio signal 105 output by the DUT 103. A measure of output quality 109 is output by the audio quality tester 107.

Transparent quality, i.e. best quality, is achieved if the processed audio signal 105 is indistinguishable from the reference audio signal 101 by any listener. The quality may be degraded if the processed signal 107 has audible distortions produced by the DUT 103.

Various conventional approaches to audio quality assessment are given by the recommendation outlined in ITU-R, "Rec. ITU-R BS.1387 Method for Objective Measurements of Perceived Audio Quality," 1998, hereafter "PEAQ", which is hereby incorporated by reference in its entirety.

PEAQ takes into account properties of the human auditory system. For example, if the difference between the processed audio signal 105 and reference signal 101 falls below the human hearing threshold, it will not degrade the audio quality. Fundamental properties of hearing that have been considered include the auditory masking effect.

However, objective assessment techniques do not employ appropriate measures to estimate deviations of the evoked auditory spatial image of a multi-channel audio signal (e.g., 2-channel stereo, 5.1 channel surround sound, etc.). Spatial image distortions are commonly introduced by low-bit rate audio coders, such as MPEG-AAC or MPEG-Surround. MPEG-AAC, for instance, provides tools for joint-channel coding, for instance "intensity stereo coding" and "sum/difference coding". The potential coding distortions caused by joint-channel coding techniques cannot be appropriately estimated by conventional assessment tools such as PEAQ simply because each audio channel is processed separately and properties of the spatial image are not taken into account.

FIG. 2 is a block diagram of the PEAQ quality assessment tool, which only supports 1 channel mono or 2-channel stereo audio. More than 2 channels are not supported.

The objective quality assessment tool 200 implements PEAQ above is divided into two main functional blocks as shown in FIG. 2. The first block 201 is a psychoacoustic model, which acts as a distortion analyzer. This block compares corresponding monaural or stereophonic channels of a reference signal 203 and a test signal 205 and produces a number of Model Output Variables (MOVs) 207. Both the reference signal 203 and the test signal 205 can be any number of channels, from monaural to multi-channel surround sound. The MOVs 207 are specific distortion measures; each of them quantifies a certain type of distortion by one value per channel. These values are subsequently averaged over all channels and output to the second major block, a neural network 209. The neural network 209 combines all MOVs 207 to derive an objective audio quality 211.

In PEAQ, since the distortions are independently analyzed in each audio channel, there is no explicit evaluation of auditory spatial image distortion. For many types of audio signals this lack of spatial image distortion analysis can cause inaccurate objective quality estimations, leading to unsatisfactory quality assessments. Thus, an audio signal may have a high quality rating according to the PEAQ standard, yet have severe spatial image distortions. This is highly undesirable in the case of high fidelity or high definition sound recordings where spatial cues are crucial to the recording, such as multi-channel (i.e., two or more channels) sound systems.

Accordingly, there is a demand for objective audio quality assessment techniques capable of evaluating spatial as well as other audio distortions in a multi-channel audio signal.

SUMMARY OF THE INVENTION

Broadly speaking, the invention pertains to techniques for assessing the quality of processed audio. More specifically, the invention pertains to techniques for assessing spatial and non-spatial distortions of a processed audio signal. The spatial and non-spatial distortions include the output of any audio processor (hardware or software) that changes the audio signal in any way which may modify the spatial image (e.g., a stereo microphone, an analog amplifier, a mixing console, etc.)

According to one embodiment, the invention pertains to techniques for assessing the quality of an audio signal in terms of audio spatial distortion. Additionally, other audio distortions can be considered in combination with audio spatial distortion, such that a total audio quality for the audio signal can be determined.

In general, audio distortions include any deformation of an audio waveform, when compared to a reference waveform. These distortions include, for example: clipping, modulation distortions, temporal aliasing, and/or spatial distortions. A variety of other audio distortions exist, as will be understood by those familiar with the art.

In order to include degradations of an auditory spatial image into quality assessment schemes, a set of spatial image distortion measures that are suitable to quantify deviations of the auditory image between a reference signal and a test signal are employed. According to one embodiment of the invention, spatial image distortions are determined by comparing a set of audio spatial cues derived from an audio test signal to the same audio spatial cues derived from an audio reference signal. These auditory spatial cues determine, for example, the lateral position of a sound image and the sound image width of an input audio signal.

In one embodiment of the invention, the quality of an audio test signal is analyzed by determining a plurality of audio spatial cues for an audio test signal, determining a corresponding plurality of audio spatial cues for an audio reference signal, comparing the determined audio spatial cues of the audio test signal to the audio spatial cues of the audio reference signal to produce comparison information, and determining the audio spatial quality of the audio test signal based on the comparison information.

In another embodiment of the invention, the quality of a multi-channel audio test signal is analyzed by selecting a plurality of audio channel pairs in an audio test signal, selecting a corresponding plurality of audio channel pairs in an audio reference signal, and determining the audio quality of the multi-channel audio test signal by comparing each of the plurality of audio channel pairs of the audio test sample to the corresponding audio channel pairs of the reference audio sample.

In still another embodiment of the invention, the quality of a multi-channel audio test signal is analyzed by determining a plurality of audio spatial cues for a multi-channel audio test signal, determining a corresponding plurality of audio spatial cues for a multi-channel audio reference signal, downmixing the multi-channel audio test signal to a single channel, downmixing the multi-channel audio reference signal to a single channel, determining audio distortions for the downmixed audio test signal, determining audio distortions for the downmixed audio reference signal, and determining the quality of the audio test signal based on the plurality of audio spatial cues of the multi-channel audio test signal, the plurality of audio spatial cues of the multi-channel audio reference signal, the audio distortions of the downmixed audio test signal, and the downmixed audio reference signal.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Broadly speaking, the invention pertains to techniques for assessing the quality of processed audio. More specifically, the invention pertains to techniques for assessing spatial and non-spatial distortions of a processed audio signal. The spatial and non-spatial distortions include the output of any audio processor (hardware or software) that changes the audio signal in any way which may modify the spatial image (e.g., a stereo microphone, an analog amplifier, a mixing console, etc.)

According to one embodiment, the invention pertains to techniques for assessing the quality of an audio signal in terms of audio spatial distortion. Additionally, other audio distortions can be considered in combination with audio spatial distortion, such that a total audio quality for the audio signal can be determined.

In general, audio distortions include any deformation of an audio waveform, when compared to a reference waveform. These distortions include, for example: clipping, modulation distortions, temporal aliasing, and/or spatial distortions. A variety of other audio distortions exist, as will be understood by those familiar with the art.

In order to include degradations of an auditory spatial image into quality assessment schemes, a set of spatial image distortion measures that are suitable to quantify deviations of the auditory image between a reference signal and a test signal are employed. According to one embodiment of the invention, spatial image distortions are determined by comparing a set of audio spatial cues derived from an audio test signal to the same audio spatial cues derived from an audio reference signal. These auditory spatial cues determine, for example, the lateral position of a sound image and the sound image width of an input audio signal.

Figure 3:
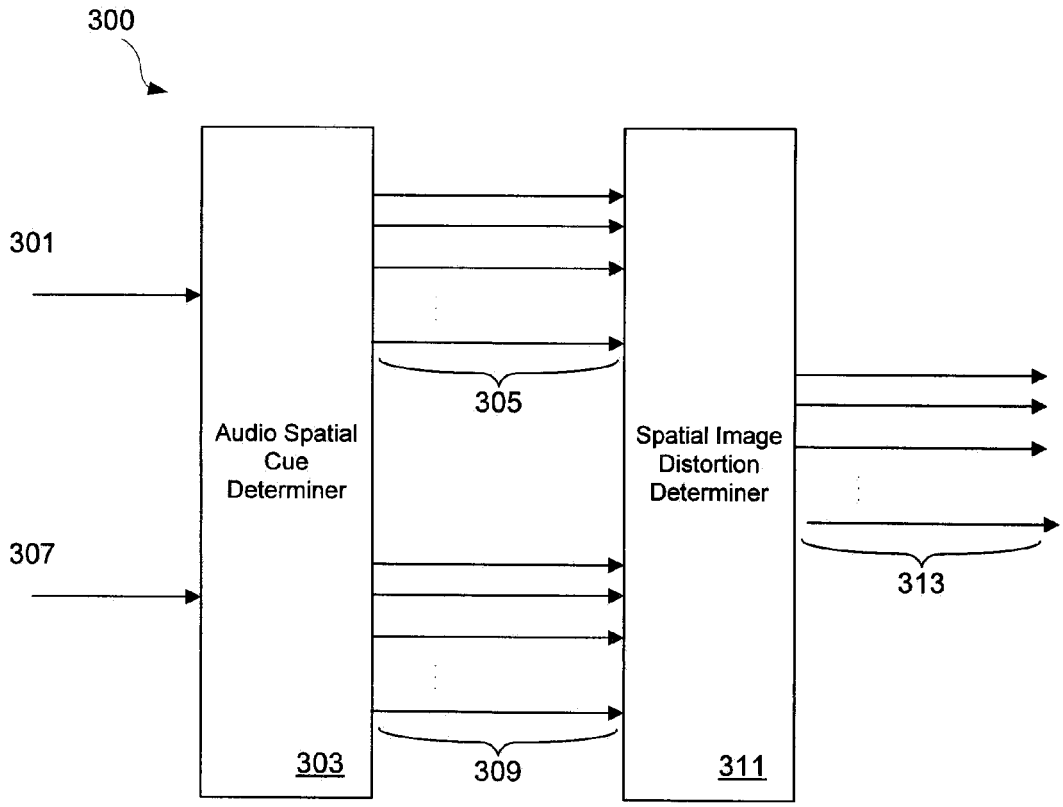
FIG. 3 is a block diagram of a spatial image distortion determiner according to one embodiment of the invention.

FIG. 3 is a block diagram of a spatial image distortion determiner 300 according to one embodiment of the invention. Audio test signal 301 is input into an audio spatial cue determiner 303, which outputs a set of audio spatial cues 305 for the audio test signal 301. Audio reference signal 307 is also input into the audio spatial cue determiner 303, yielding a set of audio spatial cues 309. These audio signals 301 and 307 can be any multi-channel input (e.g., stereo, 5.1 surround sound, etc.)

According to one embodiment of the invention, three spatial cues are output for each input. For example, the spatial cues can be an inter-channel level difference spatial cue (ICLD), an inter-channel time delay spatial cue (ICTD), and an inter-channel coherence spatial cue (ICC). Those familiar with the art will understand that other spatial distortions can additionally or alternatively be determined.

The audio spatial cues 305 for the audio test signal 301 and the audio spatial cues 309 for the audio reference signal 307 are compared in spatial image distortion determiner 311, and a set of spatial image distortions 313 are output. The set of spatial image distortions 313 has a distortion measure for each spatial cue input. For example, according to the above embodiment, a spatial image distortion can be determined for each of the ICLD, ICTD, and ICC audio spatial cues.

Figure 4:
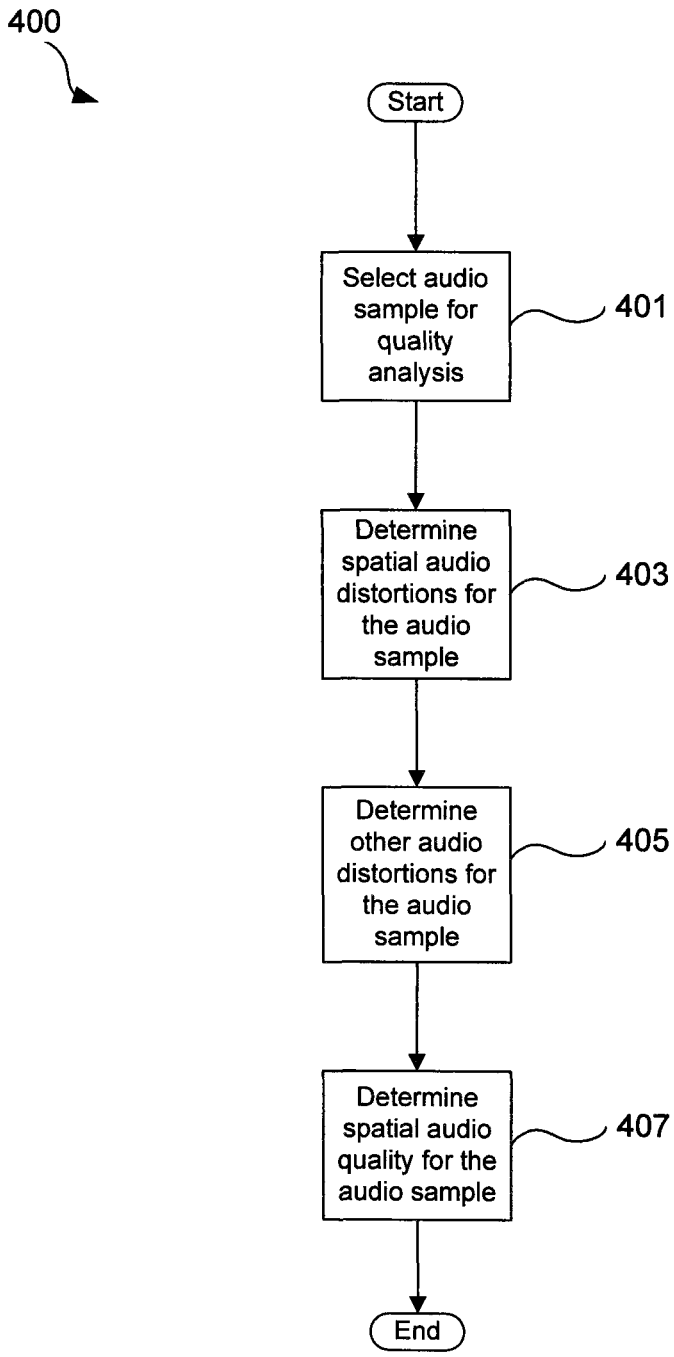
FIG. 4 is a flow diagram of a spatial image distortion evaluation process according to one embodiment of the invention.

FIG. 4 is a flow diagram of a spatial image distortion evaluation process 400 according to one embodiment of the invention. FIG. 4 begins with the selection 401 of an audio signal to analyze. The audio signal will be compared to a reference audio signal in order to determine spatial and other audio distortions. For example, the audio signal can be an MP3 file and the reference audio signal can be the original audio from which the MP3 was created. Next, one or more spatial image distortions, for example, those derived from comparisons of audio spatial cues ICLD, ICTD, and ICC as discussed above in reference to FIG. 3 can be determined 403.

Figure 1:
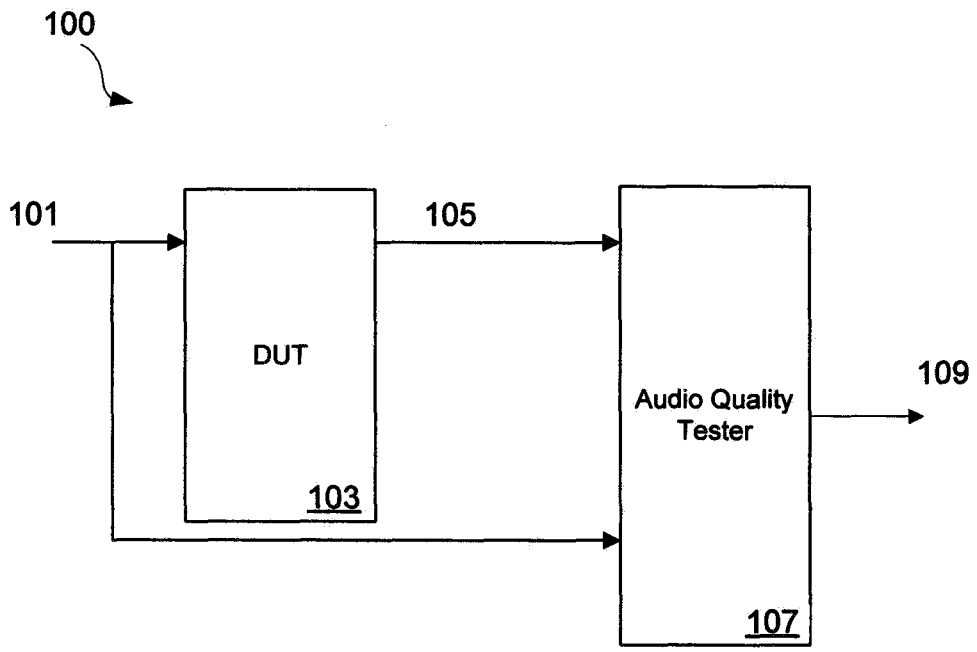
FIG. 1 is a block diagram of an audio quality testing setup.
Figure 2:
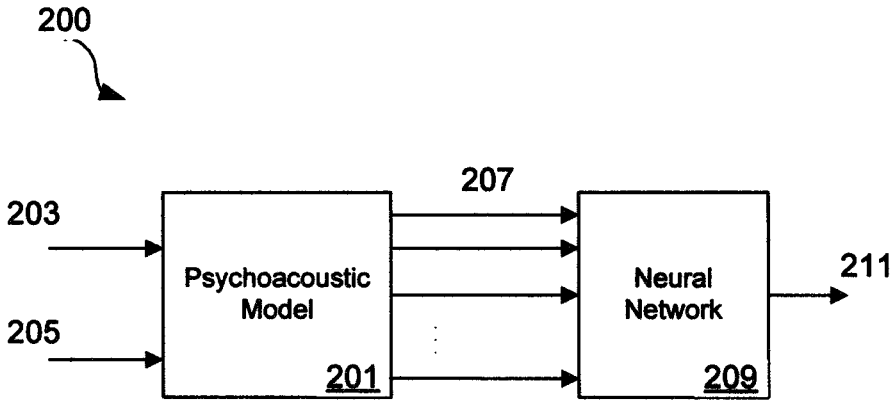
FIG. 2 is a block diagram of the PEAQ objective quality assessment tool.

Spatial image distortions rarely occur in isolation—they are usually accompanied by other distortions. This is especially true for audio coders, which typically trade off image distortions and other types of distortions to maximize overall quality. Thus, spatial image distortion measures can be combined with conventional distortion measures in order to assess overall audio quality. The spatial image distortion evaluation process 400 continues with a determination 405 of conventional audio distortions, for instance non-spatial audio distortions such as compression artifacts. Next, the audio distortions and spatial image distortions are used to determine 407 a spatial audio quality of the audio signal. There are various ways to determine the spatial audio quality of the audio signal. For instance, as one example, the spatial audio quality may be determined by feeding the spatial image distortions and other audio distortions, for example the PEAQ MOVs 207 discussed above in reference to FIG. 2, into an artificial neural network that has been taught to evaluate audio quality based on how the human auditory system perceives sound. Typically, the neural network's parameters are derived from a training procedure, which aims at minimizing the difference between known subjective quality grades from listening tests (i.e., as determined by human listeners) and the neural network output.

According to one embodiment of the invention, spatial image distortion measures, for example the spatial image distortions discussed above in reference to FIG. 3, are applied to audio signals with two or more channels. For instance, the spatial image distortions that are determined in block 405 in FIG. 4 can be calculated for one or more channel pairs. In the case of multi-channel audio signals, a plurality of channel pairs are evaluated.

Figure 5:
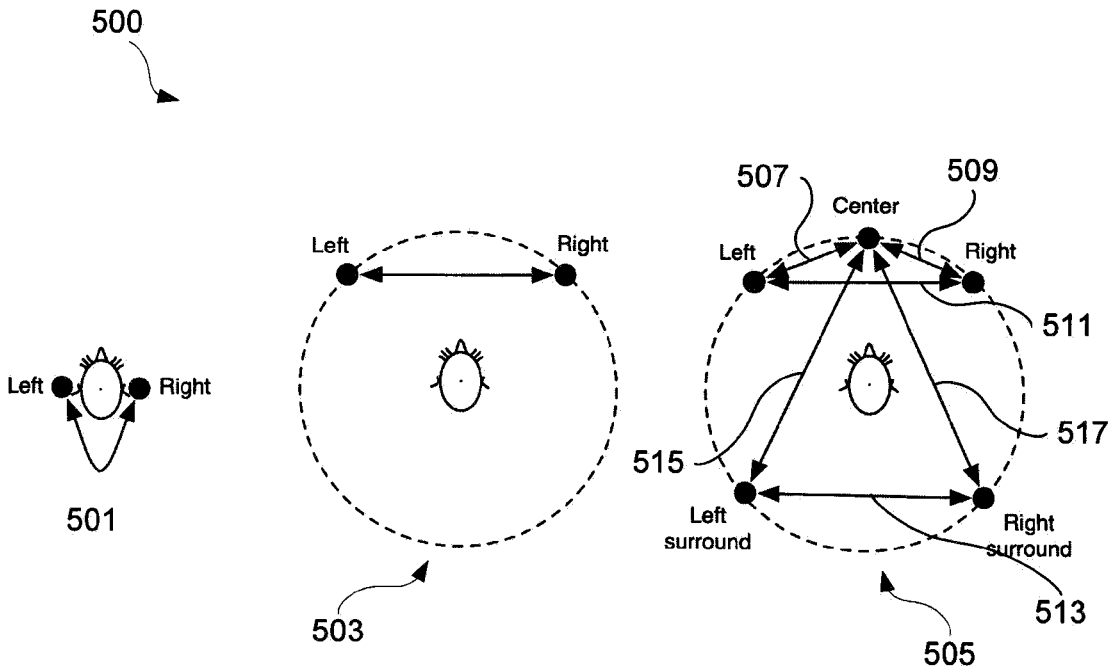
FIG. 5 is an illustration of various multi-channel audio configurations and corresponding audio channel pairs according to one embodiment of the invention.

FIG. 5 is an illustration of various multi-channel audio configurations and corresponding channel pairs according to one embodiment of the invention. According to one embodiment of the invention, spatial image distortions, for example ICLD, ICTD, and ICC as discussed above in reference to FIG. 3, are independently calculated for each channel pair. A channel pair 501, i.e., a signal supplied to a set of audio headphones (a binaural signal) is one exemplary configuration. Next, a channel pair 503 is another exemplary configuration. This configuration is supplied to a conventional stereo music system. Third, a five-channel audio group 505 is another exemplary configuration. This configuration as supplied to a surround-sound audio system is represented by six channel pairs, Left/Center 507, Center/Right 509, Left/Right 511, Left-Surround/Right-Surround 513, Center/Left-Surround 515, and Center/Right-Surround 517. Clearly, other pairs are possible.

According to one embodiment of the invention, spatial image distortions are independently calculated for each channel pair. Other multi-channel sound encoding types, including 6.1 channel surround, 7.1 channel surround, 10.2 channel surround, and 22.2 channel surround can be evaluated as well.

Figure 6:
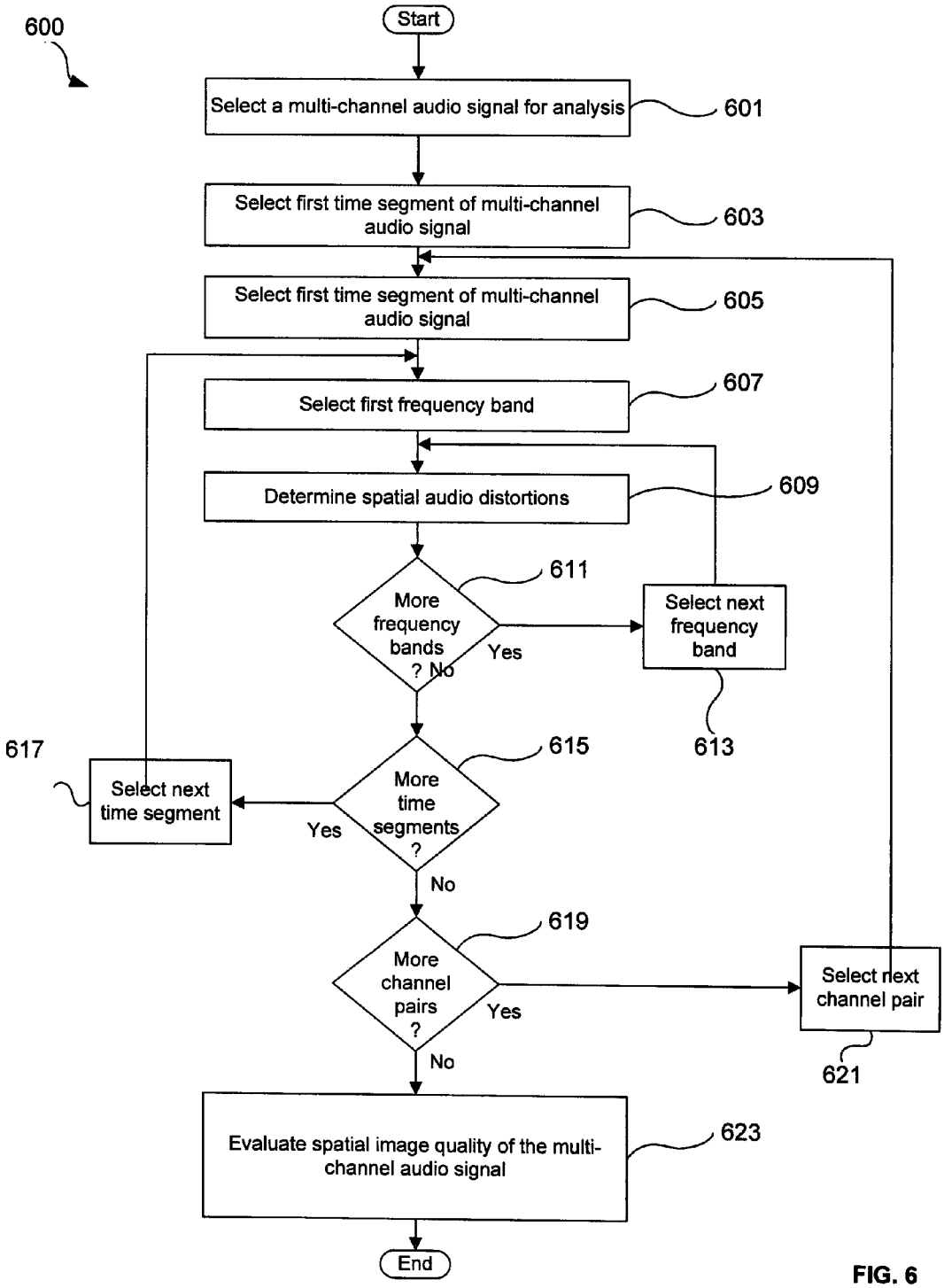
FIG. 6 is a block diagram of a spatial image distortion evaluation process according to one embodiment of the invention.

FIG. 6 is a block diagram of a spatial image distortion evaluation process 600 according to one embodiment of the invention. The spatial image distortion evaluation process 600 can determine these spatial image distortions from, for example, the three spatial image distortions (derived from ICLD, ICTD, and ICC) as discussed above in reference to FIG. 3. Further, the spatial image distortion evaluation process 600 can be performed, for example, on any of the channel configurations discussed above in reference to FIG. 4.

The spatial image distortion evaluation process 600 begins with selecting 601 of a multi-channel audio signal. For example, the audio signal can be a two-channel MP3 file (i.e., a decoded audio file) and the reference audio signal can be the unprocessed two-channel audio that was compressed to create that MP3 file. Next, a channel pair is selected 603 for comparison. After the channel pair is selected 603, a time segment of the audio signal to be compared can be selected.

An analysis can then be performed to determine spatial image distortions of the multi-channel audio signal. This analysis can employ, for example, uniform energy-preserving filter banks such as the FFT-based analyzer in Christof Faller and Frank Baumgarte, "Binaural Cue Coding—Part II: Schemes and Applications," IEEE Trans. Audio, Speech, and Language Proc., Vol. 11, No. 6, November 2003, pp. 520-531, which is hereby incorporated by reference in its entirety, or the QMF-based analyzer in ISO/IEC, "Information Technology—MPEG audio technologies—Part 1: MPEG Surround," ISO/IEC FDIS 23003-1:2006(E), Geneva, 2006, and ISO/IEC, "Technical Description of Parametric Audio Coding for High Quality Audio," ISO/IEC 14496-3-2005(E) Subpart 8, Geneva, 2005, both hereby incorporated by reference in their entirety. For complexity reasons, a filter bank with uniform frequency resolution is commonly used to decompose the audio input into a number of frequency sub-bands. Some or all of the frequency sub-bands are analyzed, typically those sub-bands that are audible to the human ear. In one embodiment of the invention, sub-bands are selected to match the "critical bandwidth" of the human auditory system. This is done in order to derive a frequency resolution that is more appropriate for modeling human auditory perception.

The spatial image distortion evaluation process 600 continues with selection 607 of a frequency sub-band for analysis. Next, the spatial image distortions are determined 609 for the selected frequency sub-band. A decision 611 then determines if there are more frequency sub-bands to be analyzed. If so, the next frequency sub-band is selected 613 and the spatial image distortion evaluation process 600 continues to block 609 and subsequent blocks to analyze the spatial image distortions for such frequency sub-band.

On the other hand, if there are no more frequency sub-bands to analyze, the spatial image distortion evaluation process 600 continues with a decision 615 that determines if there are more time segments to analyze. If there are more time segments to analyze, the next time segment is selected 617 and the spatial image distortion process 600 continues to block 607 and subsequent blocks. Otherwise, if there are no more time segments to analyze, a decision 619 determines if there are more channel pairs to be analyzed. If there are, then the next channel pair is selected 621 and the spatial image distortion evaluation process 600 continues to block 603 and subsequent blocks.

If there are no more channel pairs to be analyzed, then the end of the multi-channel audio signal has been reached (i.e., the entire multi-channel audio signal has been analyzed), and the spatial image distortion evaluation process 600 continues with a evaluation 623 of the spatial image distortions for the multi-channel audio signal and the process ends.

Those familiar with the art will understand that the order in which the time-segment and frequency sub-bands loops are analyzed are matters of programming efficiency and will vary. For example, in FIG. 6, the time-segment loop is nested, but could alternatively be the outer loop instead of the channel-pair selection loop being the outer loop.

Figure 7A:
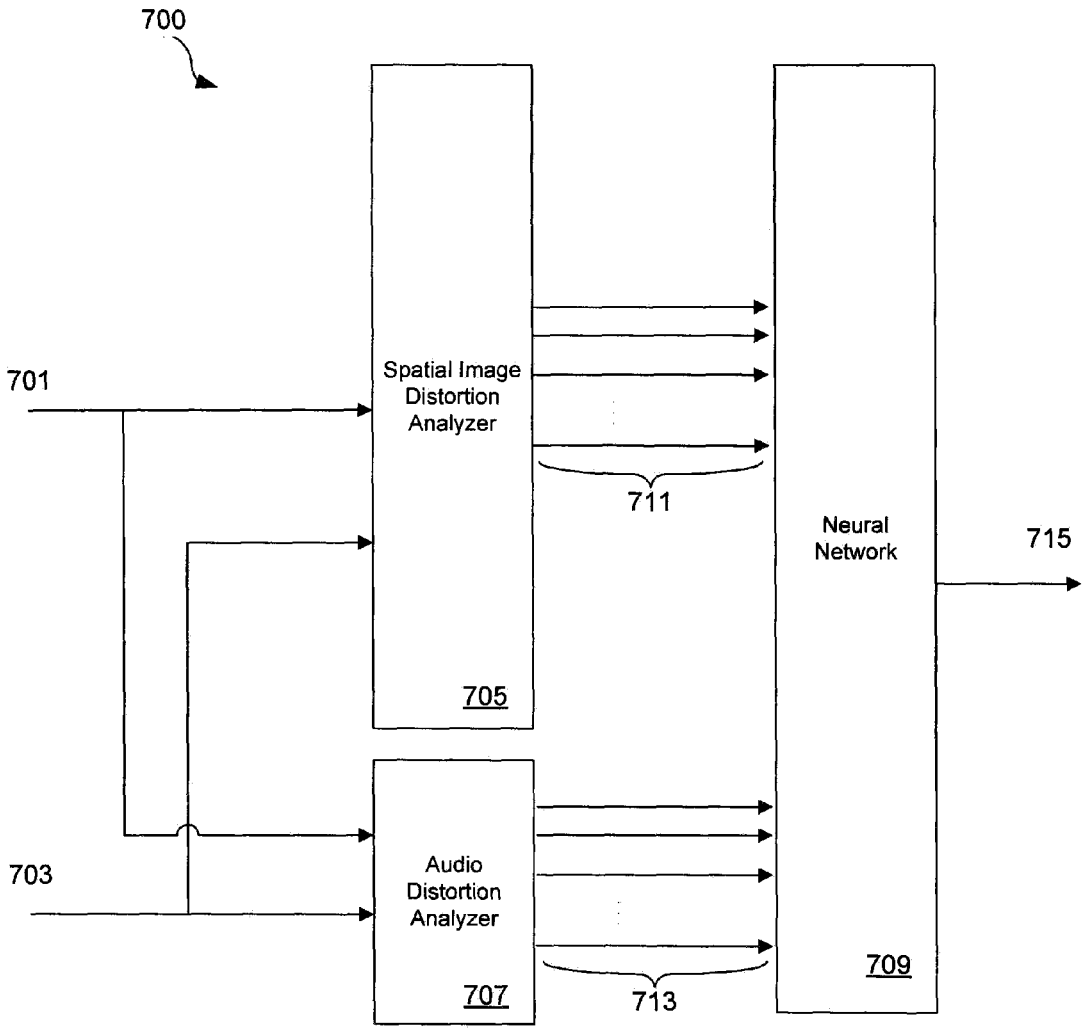
FIG. 7A is a block diagram of an exemplary audio quality analyzer according to one embodiment of the invention.

FIG. 7A is a block diagram of an exemplary audio quality analyzer 700 according to one embodiment of the invention.

An audio test signal 701 and an audio reference signal 703 are supplied to the audio quality analyzer 700. The audio test signal 701 can be, for example, a two-channel MP3 file (i.e., a decoded audio file) and the reference audio signal 703 can be, for example, the unprocessed two-channel audio that was compressed to create test audio signal 701. The audio test signal 701 and the reference audio signal 703 are both fed into a spatial image distortion analyzer 705 and into an audio distortion analyzer 707.

The audio quality analyzer 700 has a neural network 709 that takes outputs 711 from the spatial image distortion analyzer 705 and outputs 713 from the audio distortion analyzer 707. The outputs 711 from the spatial image distortion analyzer 705 can be, for example, the spatial image distortions 313 of the spatial distortion determiner 300 described above in FIG. 3. The outputs 713 from the audio distortion analyzer 707 can be, for example, the PEAQ MOVs 207 described above in FIG. 2.

The neural network 709 can be a computer program that has been taught to evaluate audio quality based on how the human auditory system perceives sound. Typically, parameters used by the neural network 709 are derived from a training procedure, which aims at minimizing the difference between known subjective quality grades from listening tests (i.e., as determined by human listeners) and the neural network output 705. Thus, the neural network output 715 is an objective (i.e., a calculatable number) overall quality assessment of the quality of the audio test signal 701 as compared to the reference audio signal 703.

Figure 7B:
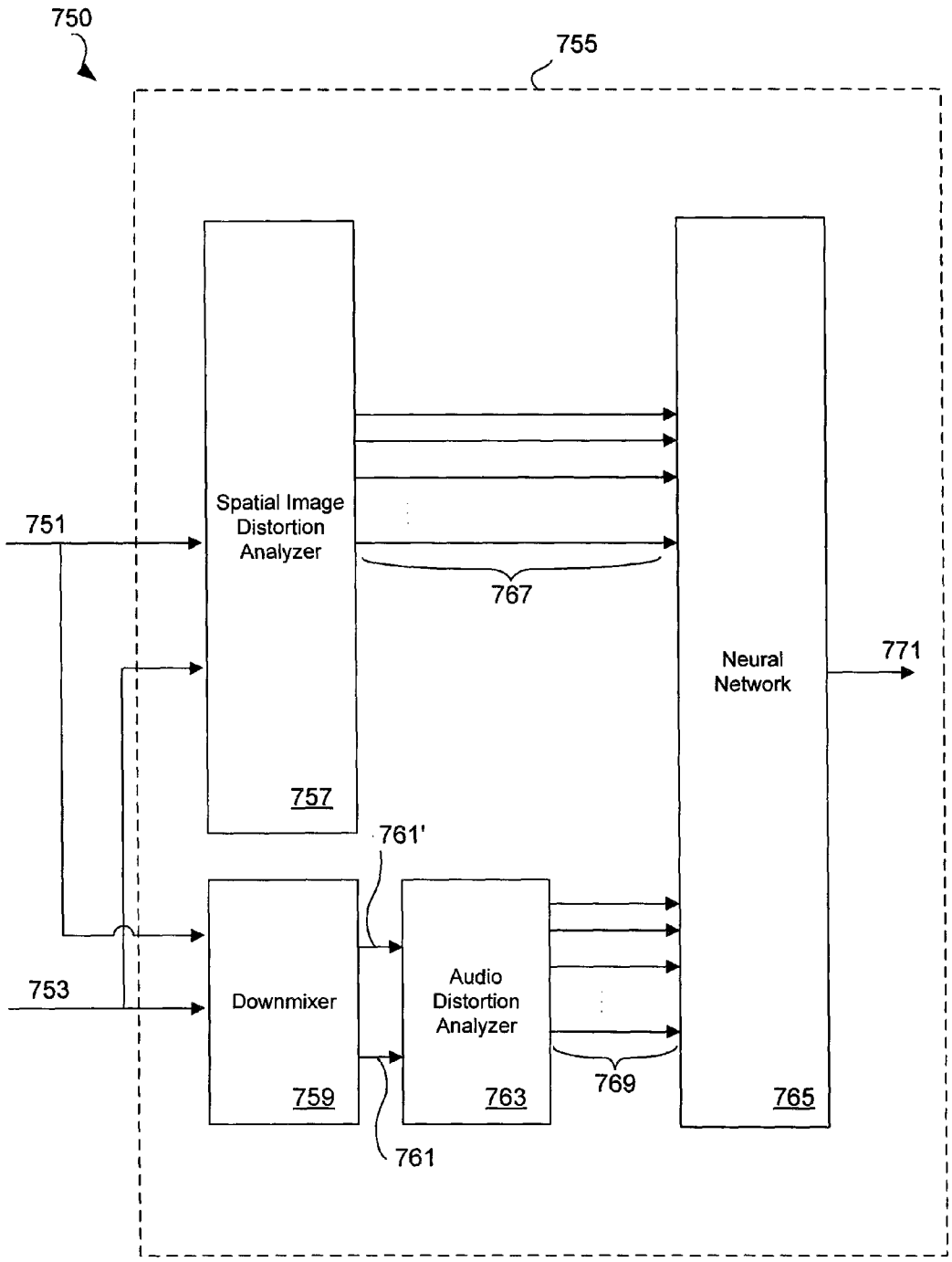
FIG. 7B is a block diagram of an exemplary audio quality analyzer according to one embodiment of the invention.

FIG. 7B is a block diagram of an exemplary audio quality analyzer 750 according to a second embodiment of the invention.

A multi-channel audio test signal 751 and a multi-channel audio reference signal 753 are supplied to the simplified audio quality analyzer 755. The multi-channel audio test signal 751 can be, for example, a two-channel MP3 file (i.e., a decoded audio file) and the multi-channel reference audio signal 753 can be, for example, the unprocessed two-channel audio that was compressed to create test audio signal 751. The multi-channel audio test signal 751 is fed into a spatial image distortion analyzer 757.

The multi-channel audio test signal 751 and the multi-channel audio reference signals are also down-mixed to mono in downmixer 759. The monaural outputs of downmixer 759 (monaural audio test signal 761 and monaural audio reference signal 761') are fed into an audio distortion analyzer 763. This embodiment has the advantage of lower computational complexity in the audio distortion analyzer 763 as compared to the audio distortion analyzer 705 in FIG. 7A since only a single downmixed channel (mono) is analyzed.

The audio quality analyzer 750 has a neural network 765 that takes outputs 767 from the spatial image distortion analyzer 757 and outputs 769 from the audio distortion analyzer 763. The outputs 757 from the spatial image distortion analyzer 757 can be, for example, the spatial image distortion outputs 313 of the spatial distortion determiner 300 described above in FIG. 3. The outputs 769 from the audio distortion analyzer 763 can be, for example, the PEAQ MOVs 207 described above in FIG. 2.

The neural network 765 can be a computer program that been taught to evaluate audio quality based on how the human auditory system perceives sound. Typically, the parameters used by the neural network 765 are derived from a training procedure, which aims at minimizing the difference between known subjective quality grades from listening tests (i.e., as determined by human listeners) and the neural network output 771. Thus, the neural network output 771 is an objective (i.e., calculatable) overall quality assessment of the quality of the audio test signal 751 as compared to the reference audio signal 753.

IMPLEMENTATION EXAMPLE

An exemplary implementation of a spatial audio quality assessment is described below.

The estimation of spatial cues can be implemented in various ways. Two examples are given in Frank Baumgarte and Christof Faller, "Binaural Cue Coding—Part I: Psychoacoustic Fundamentals and Design Principles," IEEE Trans. Audio, Speech, and Language Proc., Vol. 11, No. 6, November 2003, which is hereby incorporated by reference in its entirety, and in "Binaural Cue Coding—Part II: Schemes and Applications," referenced above. Alternative implementations can be found in ISO/IEC, "Information Technology—MPEG audio technologies—Part 1: MPEG Surround," ISO/IEC FDIS 23003-1:2006(E), Geneva, 2006, and ISO/IEC, "Technical Description of Parametric Audio Coding for High Quality Audio," ISO/IEC 14496-3-2005(E) Subpart 8, Geneva, 2005, both of which are hereby incorporated by reference in their entirety.

Figure 8:
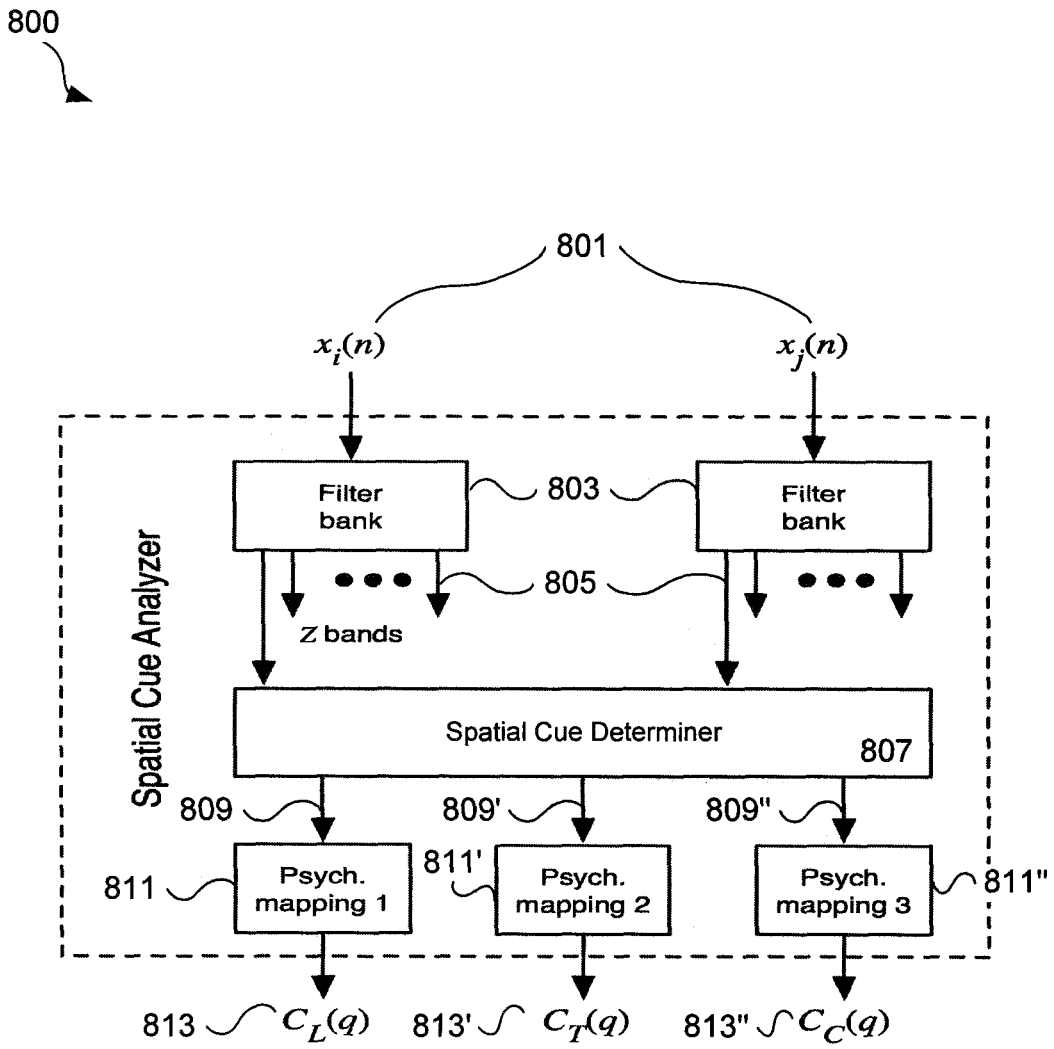
FIG. 8 is an exemplary spatial cue analyzer according to one embodiment of the invention.

A spatial cue analyzer 800 is shown in FIG. 8. The input consists of the audio signals of a channel pair 801 with channels $x_1(n)$ and $x_2(n)$, where n is a time index indicating which time segment of the audio signal is being analyzed (as described in 605 of FIG. 6). Each signal is divided into Z sub-bands 805 with approximately critical bandwidth in filter bank 803. In each band, three spatial cues 809, 809' and 809" are calculated in spatial cue determiner 807. Each of the three spatial cues 809 are then mapped with a psychoacoustically-motivated function (811, 811', and 811") so that the output is proportional to the perceived auditory image distortion. The mapping characteristics are different for each of the three cues. The outputs of the spatial analyzer consist of mapped spatial cues 813 ($C_L(q)$), 813' ($C_T(q)$), and 813" ($C_C(q)$). These values may be updated at a lower rate than the input audio signal, hence the different time index q.

Figure 9:
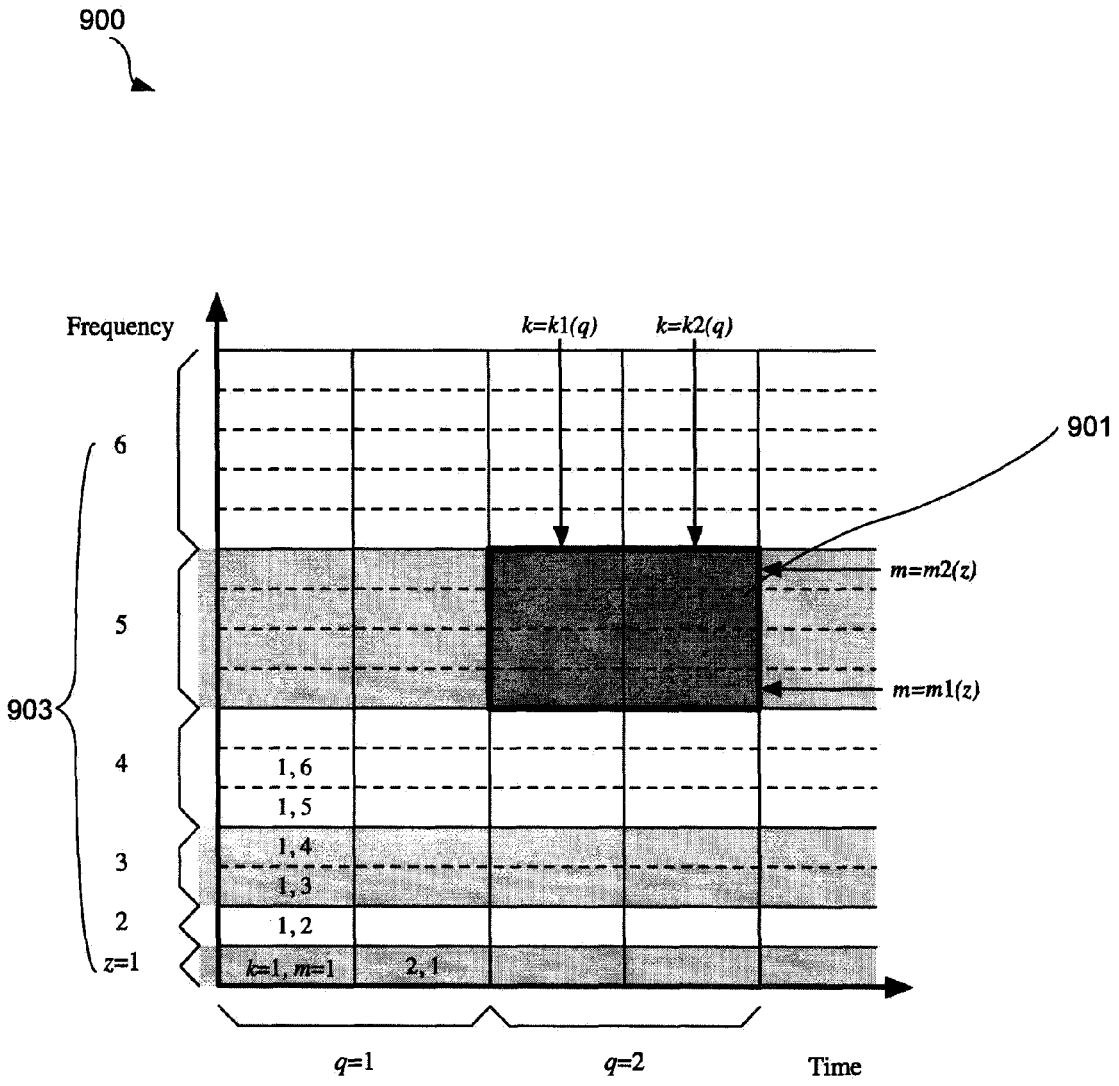
FIG. 9 is an exemplary time-frequency grid according to one embodiment of the invention.

A specific set of formulas for spatial cue estimation are described. However, a different way may be chosen to calculate the cues depending on the tradeoff between accuracy and computational complexity for a given application. The formulas given here can be applied in systems that employ uniform energy-preserving filter banks such as the FFT-based analyzer in or the QMF-based analyzer in "Binaural Cue Coding—Part II: Schemes and Applications," referenced above. The time-frequency grid obtained from such an analyzer is shown in FIG. 9, which shows a set of time-frequency tiles 901 illustrating the filter bank resolution in time (index k) and frequency (index m). The left side illustrates that several filter bank bands 903 are included in a critical band (index z). At the bottom, a time interval with index q can contain several time samples. Each of the uniform tiles illustrates the corresponding time and frequency of one output value of the filter bank.

For complexity reasons a filter bank with uniform frequency resolution is commonly used to decompose the audio input into a number of M sub-bands. In contrast, the frequency resolution of the auditory system gradually decreases with increasing frequency. The bandwidth of the auditory system is called "critical" bandwidth and the corresponding frequency bands are referred to as critical bands. In order to derive a frequency resolution that is more appropriate for modeling auditory perception, several neighboring uniform frequency bands are combined to approximate a critical band with index z as shown in FIG. 9.

The ICLD ΔL for a time-frequency tile (shown as bold outlined rectangle 901 in FIG. 9) of an audio channel pair of channels i and j is computed according to (1). The tile sizes are controlled by the functions for the time interval boundary, k1(q) and k2(q), and the critical band boundaries, m1(z) and m2(z). The normalized cross-correlation Φ for a time-frequency tile is given in (2). The cross-correlation is calculated for a range of delays d, which correspond to an audio signal delay range of −1 to 1 ms. The ICTD τ is then derived from the delay d at the maximum absolute cross-correlation value as given in (3). Finally, the ICC Ψ is the cross-correlation at delay d=τ according to (4).

$$\Delta L_{i,j}(q, z)10\log\left(\frac{\sum_{k=k1(q)}^{k2(q)}\sum_{m=m1(z)}^{m2(z)} X_i(k, m)X_i^*(k, m)}{\sum_{k=k1(q)}^{k2(q)}\sum_{m=m1(z)}^{m2(z)} X_j(k, m)X_j^*(k, m)}\right) \tag{1}$$

$$\Phi_{i,j}(q, z, d) = Re\left\{\frac{\sum_{k=k1(q)}^{k2(q)}\sum_{m=m1(z)}^{m2(z)} X_i(k, m)X_j^*(k+d, m)}{\sqrt{\sum_{k=k1(q)}^{k2(q)}\sum_{m=m1(z)}^{m2(z)} X_i(k, m)X_i^*(k, m)\sum_{k=k1(q)}^{k2(q)}\sum_{m=m1(z)}^{m2(z)} X_j(k, m)X_j^*(k, m)}}\right\} \tag{2}$$

$$\tau_{i,j}(q, z) = \underset{d}{\operatorname{argmax}}\{|\Phi_{i,j}(q, z, d)|\} \tag{3}$$

$$\Psi_{i,j}(q, z) = \Phi_{i,j}(q, z, \tau_{i,j}(q, z)) \tag{4}$$

The three spatial cues are then mapped to a scale, which is approximately proportional to the perceived spatial image change. For example, a very small change of a cross-correlation of 1 is audible, but such a change is inaudible if the cross-correlation is only 0.5. Or, a small change of a level difference of 40 is not audible, but it could be audible if the difference is 0. The mapping functions for the three cues are $H_L$, $H_T$, and $H_C$, respectively.

$$C_L(q)=H_L(\Delta L(q)) \tag{5}$$

$$C_T(q)=H_T(\tau(q)) \tag{6}$$

$$C_C(q)=H_C(\Psi(q)) \tag{7}$$

An example of a mapping function for ICLDs:

$$C_L = \frac{1}{1+e^{-0.15\Delta L}} = H_L(\Delta L)$$

An example of a mapping function for ICCs:

$$C_C=(1.0119-\Psi)^{0.4}=H_C(\Psi)$$

An example of a mapping for ITDs:

$$C_T = \frac{1}{1+e^{-2000\tau[s]}} = H_T(\tau)$$

Figure 10A:
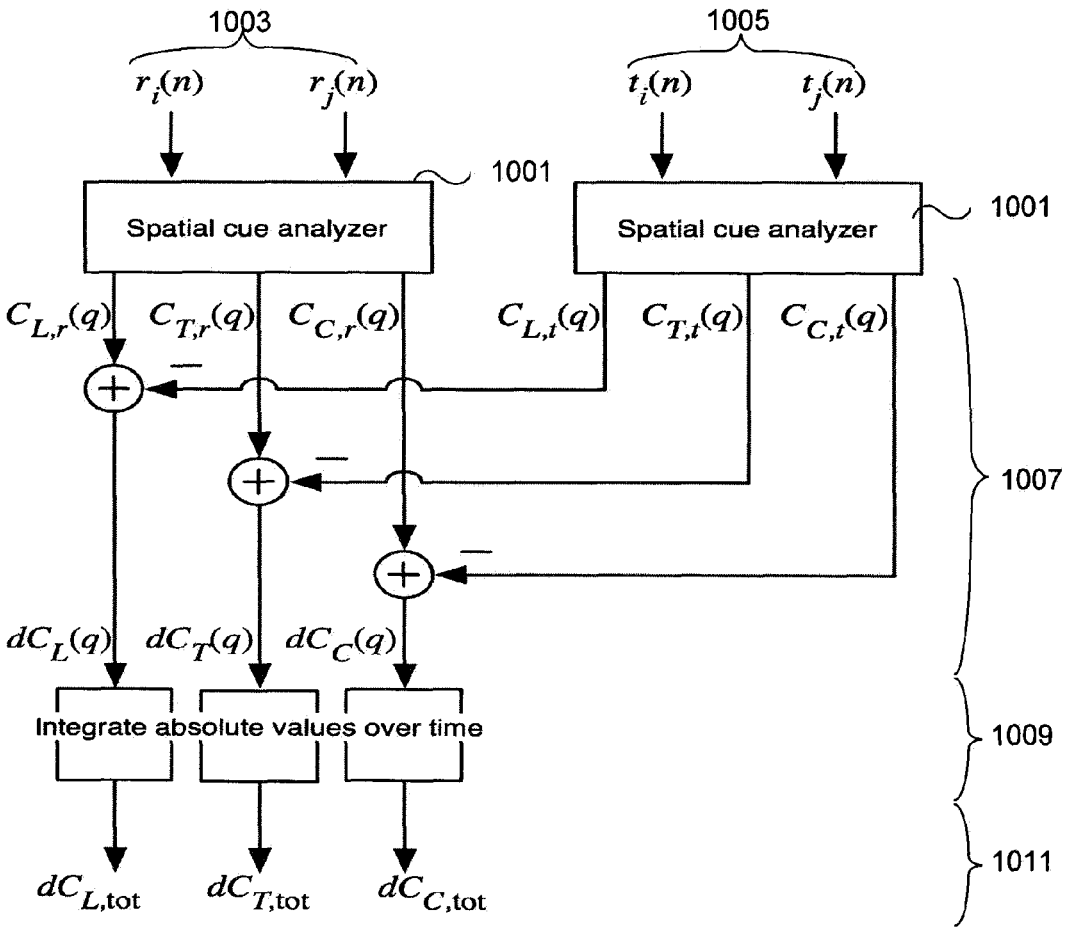
FIG. 10A is an exemplary spatial cue analyzer according to one embodiment of the invention.

In order to estimate spatial image distortions, the mapped cues of corresponding channel pairs p of the reference and test signal are compared as outlined in FIG. 10A. A spatial cue analyzer 1001 is applied to a reference channel pair 1003 and a test channel pair 1005. The magnitude of the difference of the output is then calculated 1007 and integrated 1009 over time (for the whole duration of the audio signal). The integration can be done, for instance, by averaging the difference over time. At the output of this stage we have spatial distortion measures 1011 based on ICLD, ICTD, and ICC for each channel pair p and each critical band z, namely $dC_{L,tot}(z,p)$, $dC_{T,tot}(z,p)$, and $dC_{C,tot}(z,p)$, respectively.

Figure 10B:
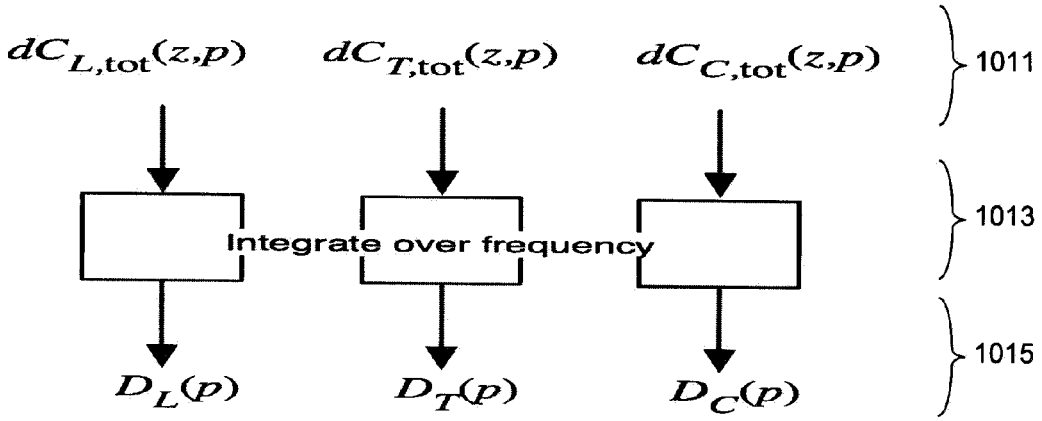
FIG. 10B is an exemplary diagram showing the integration of spatial distortion measures according to one embodiment of the invention.

Next, the spatial distortion measures 1011 are integrated 1013 over frequency, as shown in FIG. 10B. The integration can be done, for instance, by simple averaging over all bands. For the final distortion measures, the values for all channel pairs are combined into a single value. This can be done by weighted averaging, where, for instance, the front channels in a surround configuration can be given more weight than the rear channels. The final three values which describe the spatial image distortions 1015 of the test audio signal with respect to the reference audio signal are $D_{L,tot}$, $D_{T,tot}$, and $D_{C,tot}$.

Figure 10C:
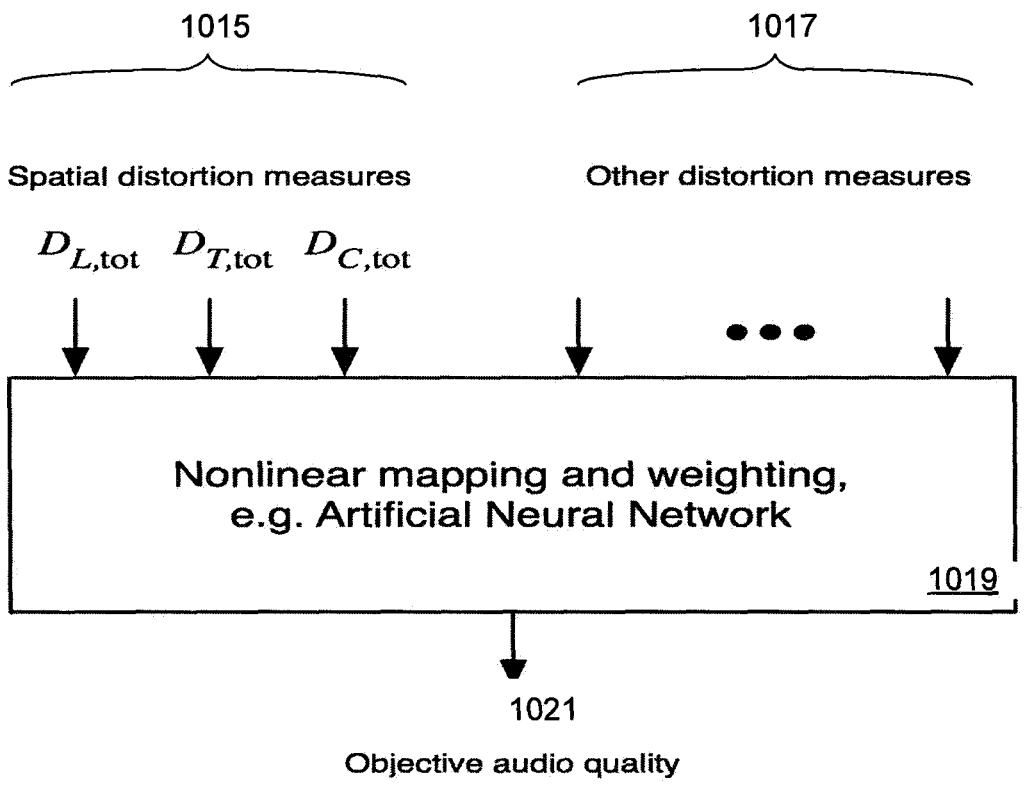
FIG. 10C is an exemplary diagram showing an artificial neural network according to one embodiment of the invention.

Spatial image distortions rarely occur in isolation—they are usually accompanied by other distortions. This is especially true for audio coders, which typically trade off image distortions and other types of distortions to maximize overall quality. Therefore, spatial distortion distortions 1015 can be combined with conventional distortion measures in order to assess overall audio quality. The system in FIG. 10C shows an example of an Artificial Neural Network 1019 that combines spatial distortion measures 1015 and other distortion measures 1017. The Neural Network parameters are usually derived from a training procedure, which teaches the neural network to emulate known subjective quality grades from listening tests (i.e., those performed by human listeners) to produce an objective (i.e., calculatable) overall quality assessment 1021.

If only the spatial image distortion measures 1015 are applied to the Neural Network 1019, the objective audio quality 1021 will predominantly reflect the spatial image quality only and ignore other types of distortions. This option may be useful for applications that can take advantage of an objective quality estimate that reflects spatial distortions only.

Figure 11:
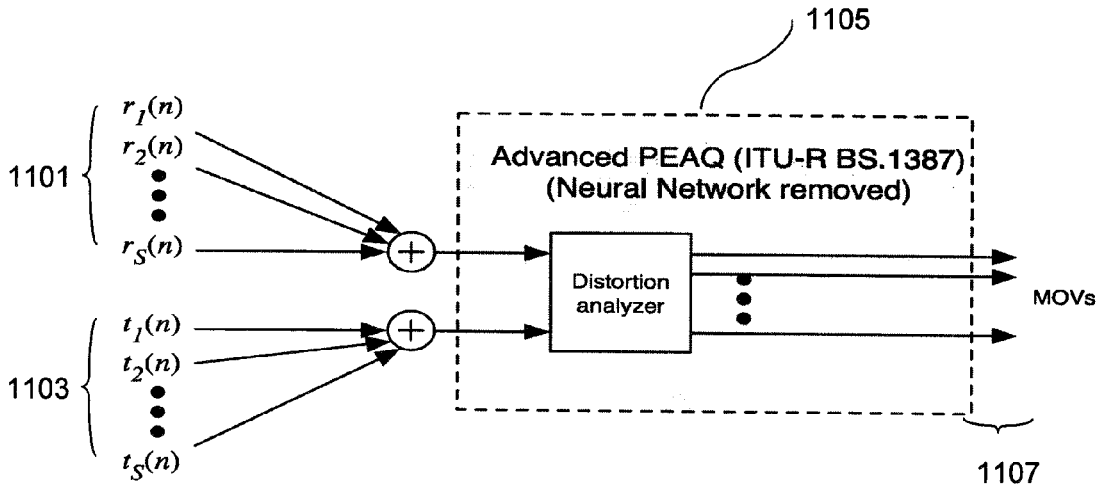
FIG. 11 is an exemplary diagram showing one option for generating conventional distortion measures according to one embodiment of the invention.

The other distortion measures 1017 besides the spatial distortions 1015 can be, for instance, the MOVs of PEAQ, or distortion measures of other conventional models. Another option for generating conventional distortion measures is shown in FIG. 11. A multi-channel reference input 1101 and a multi-channel test input 1103 are each down-mixed to mono before the PEAQ analyzer 1105 is applied. The output MOVs 1107 can be used in combination with the spatial distortion measures. This approach has the advantage of lower computational complexity and it removes the spatial image, which is generally considered irrelevant for PEAQ.

The advantages of the invention are numerous. Different embodiments or implementations may, but need not, yield one or more of the following advantages. One advantage is that spatial audio distortions can be objectively analyzed. Another advantage is using a downmixed signal to analyze conventional audio distortions can reduces computational complexity. Still another advantage is unlike PEAQ and other similar audio analyses, the invention allows for the analysis of multi-channel audio signals.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A computer-implemented method for operating a computer having a processor to analyze the quality of a multi-channel audio test signal, comprising:

(a) determining a plurality of audio spatial cues for a plurality of different pairings of channels in the multi-channel audio test signal;

(b) determining a corresponding plurality of audio spatial cues for a corresponding plurality of the different pairings of channels in a multi-channel audio reference signal distinct from the multi-channel audio test signal;

(c) comparing the determined audio spatial cues of the plurality of different pairings of channels in the multi-channel audio test signal to the audio spatial cues of the corresponding plurality of different pairings of channels in the multi-channel audio reference signal to produce comparison information; and (d) determining, at the processor, a computational measure of the audio spatial quality of the multi-channel audio test signal based on the comparison information.

2. The computer-implemented method of claim 1, wherein the plurality of audio spatial cues and the corresponding plurality of audio spatial cues are selected from the group consisting of: interchannel level difference (ICLD), inter-channel time delay (ICTD), and inter-channel coherence (ICC).

3. The computer-implemented method of claim 1, wherein the multi-channel audio test signal is selected from the group comprising 5.1 channel surround sound, 6.1 channel surround sound, and 7.1 channel surround sound.

4. The computer-implemented method of claim 1, wherein the audio spatial cues of the multi-channel audio test signal are weighted before the determining (d) of the audio spatial quality.

5. The computer-implemented method of claim 1, wherein comparing (c) further comprises determining audio spatial distortions of the multi-channel audio test signal based on the audio spatial cues of the multi-channel audio test signal and the audio spatial cues of the multi-channel audio reference signal; and wherein determining (d) further comprises determining the audio spatial quality of the multi-channel audio test signal based on the audio spatial distortions.

6. The computer-implemented method of claim 1, wherein determining (d) further comprises:

determining a plurality of audio distortions for the multi-channel audio test signal;

determining a plurality of audio distortions for the multi-channel audio reference signal;

determining an audio quality of the multi-channel audio test signal based on the audio distortions of the multi-channel audio test signal and the audio distortions of the multi-channel audio reference signal; and determining the audio spatial quality of the multi-channel audio test signal based on the audio spatial cues of the multi-channel audio test signal, the audio spatial cues of the multi-channel audio reference signal, and the audio quality of the multi-channel audio test signal.

7. The computer-implemented method of claim 1, wherein said determining (a) of the audio spatial cues for the multi-channel audio test signal use at least one psychoacoustically-motivated mapping function.

8. The computer-implemented method of claim 7, wherein the at least one psychoacoustically-motivated mapping function operates to scale the audio spatial cues for the multi-channel audio test signal approximately proportional to perceived spatial image distortion.

9. The computer-implemented method of claim 7, wherein said determining (b) of the audio spatial cues for the multi-channel audio reference signal use at least one psychoacoustically-motivated mapping function.

10. The computer-implemented method of claim 9, wherein the at least one psychoacoustically-motivated mapping function operates to scale the audio spatial cues for the multi-channel audio reference signal approximately proportional to perceived spatial image distortion.

11. A method performed by a processor for analyzing the quality of a multi-channel audio test signal, comprising:

(a) selecting a plurality of audio channel pairs in the multi-channel audio test signal;

(b) selecting a corresponding plurality of audio channel pairs in a multi-channel audio reference signal that is distinct from the multi-channel audio test signal; and (c) determining, at the processor, (c)(1) a plurality of audio spatial cues for each of the plurality of channel pairs in the multi-channel audio test signal;

(c)(2) a corresponding plurality of audio spatial cues for each of the corresponding plurality of channel pairs in the multi-channel audio reference signal; and (c)(3) the audio quality of the multi-channel audio test signal by comparing the plurality of audio spatial cues for each of the plurality of channel pairs in the multi-channel audio test signal and the corresponding plurality of audio spatial cues for each of the corresponding plurality of channel pairs in the multi-channel audio reference signal.

12. The method of claim 11, wherein the multi-channel audio test signal is selected from the group comprising, two-channel stereo, two-channel binaural, 5.1 channel surround sound, 6.1 channel surround sound, and 7.1 channel surround sound.

13. A computer-implemented method for analyzing the quality of a multi-channel audio test signal, comprising:

(a) determining a plurality of audio spatial cues for each of a plurality of different pairings of channels of the multi-channel audio test signal;

(b) determining a corresponding plurality of audio spatial cues for each of a plurality of the different pairings of channels of a multi-channel audio reference signal distinct from the multi-channel audio test signal;

(c) downmixing the multi-channel audio test signal to a single channel;

(d) downmixing the multi-channel audio reference signal to a single channel;

(e) determining audio distortions for the downmixed audio test signal;

(f) determining audio distortions for the downmixed audio reference signal; and (g) determining a computational measure of the quality of the multi-channel audio test signal based on the plurality of audio spatial cues for each of the plurality of different pairings of channels of the multi-channel audio test signal, the plurality of audio spatial cues for each of a plurality of different pairings of channels of the multi-channel audio reference signal, the audio distortions of the downmixed audio test signal, and the downmixed audio reference signal.

14. A non-transitory computer readable medium including at least computer-executable program code for analyzing the quality of a multi-channel audio test signal, said computer readable medium comprising:

computer-executable program code for determining a plurality of audio spatial cues for a plurality of different pairings of channels of the multi-channel audio test signal;

computer-executable program code for determining a corresponding plurality of audio spatial cues for a plurality of the different pairings of channels of a multi-channel audio reference signal distinct from the multi-channel audio test signal;

computer-executable program code for comparing the determined audio spatial cues of the multi-channel audio test signal to the audio spatial cues of the multi-channel audio reference signal to produce comparison information; and computer-executable program code for determining a computational measure of the audio spatial quality of the multi-channel audio test signal based on the comparison information.

15. A computer system for determining audio spatial quality, comprising:

a hardware processor;

a memory unit for storing a spatial distortion analyzer and audio distortion analyzer for:

(a) determining a plurality of audio spatial cues for a plurality of different pairings of channels in a multi-channel audio test signal;

(b) determining a corresponding plurality of audio spatial cues for a corresponding plurality of the different pairings of channels in a multi-channel audio reference signal distinct from the multi-channel audio test signal;

(c) comparing the determined audio spatial cues of the plurality of different pairings of channels in the multi-channel audio test signal to the audio spatial cues of the corresponding plurality of different pairings of channels in the multi-channel audio reference signal to produce comparison information; and (d) determining, at the processor, a computational measure of the audio spatial quality of the multi-channel audio test signal based on the comparison information.

16. The computer system of claim 15, wherein the plurality of audio spatial cues and the corresponding plurality of audio spatial cues are selected from the group consisting of: inter-channel level difference (ICLD), interchannel time delay (ICTD), and inter-channel coherence (ICC).

17. The computer system of claim 15, wherein the audio spatial cues of the multi-channel audio test signal are weighted before the determining (d) of the audio spatial quality.

18. The computer system of claim 15, wherein comparing (c) further comprises determining audio spatial distortions of the multi-channel audio test signal based on the audio spatial cues of the multi-channel audio test signal and the audio spatial cues of the multi-channel audio reference signal; and wherein determining (d) further comprises determining the audio spatial quality of the multi-channel audio test signal based on the audio spatial distortions.

19. The computer-implemented method of claim 1, wherein the multi-channel audio test signal is a processed version of the multi-channel audio reference signal.

* * * * *